US006131556A

United States Patent [19]

Villarreal

[11] Patent Number: 6,131,556

[45] Date of Patent: Oct. 17, 2000

[54] ARCHERY BOW STAND

[76] Inventor: Carlos L. Villarreal, 206 W. Martha Louise, Edinburg, Tex. 78559

[21] Appl. No.: 09/395,134

[22] Filed: Sep. 13, 1999

[51] Int. Cl.[7] ..... F41B 5/14

[52] U.S. Cl. ..... 124/86; 248/309.1

[58] Field of Search ..... 124/23.1, 86; 248/309.1, 248/169, 463

[56] References Cited

U.S. PATENT DOCUMENTS

| | | | |
|---|---|---|---|
| D. 260,674 | 9/1981 | Simmons et al. . | |
| D. 406,302 | 3/1999 | Simpson et al. | D22/107 |
| 3,256,872 | 6/1966 | Koser . | |
| 4,360,179 | 11/1982 | Roberts . | |
| 4,474,296 | 10/1984 | Hartman . | |
| 4,993,398 | 2/1991 | Wallace | 124/23.1 |
| 5,106,044 | 4/1992 | Regard et al. . | |
| 5,711,467 | 1/1998 | Brown . | |
| 5,775,658 | 7/1998 | Englehardt . | |

*Primary Examiner*—John A. Ricci
*Attorney, Agent, or Firm*—G. Turner Moller

[57] ABSTRACT

An archery bow stand provides a horizontal slot for loosely receiving the bow adjacent the upper or lower end and a base comprising a pair of legs. The bow is placed in the slot and leaned forwardly so the bow stabilizer contacts the ground. The bow stand is inclined relative to the bow so the slot inclines thereby placing the bow and bow stand in a bind. The bow stand preferably has two legs so the bow, in its supported position, is a stable tripod-like arrangement.

19 Claims, 1 Drawing Sheet

Fig. 1
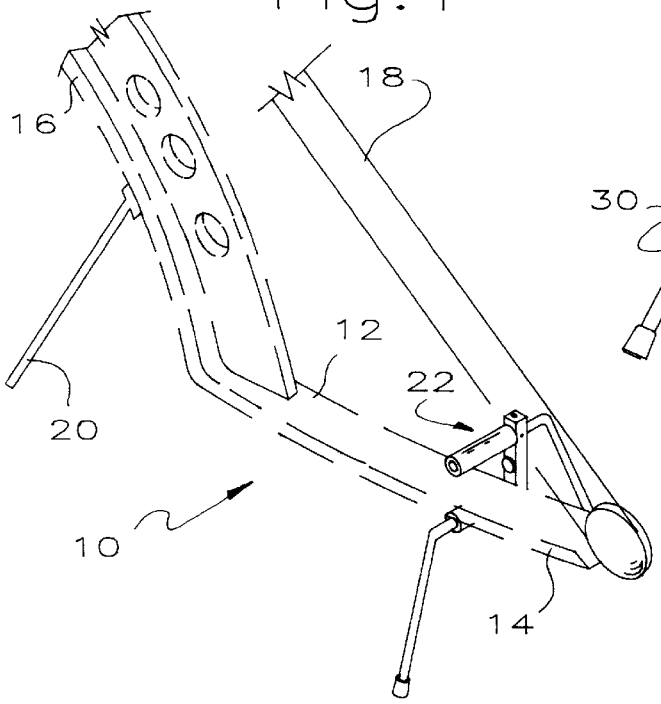
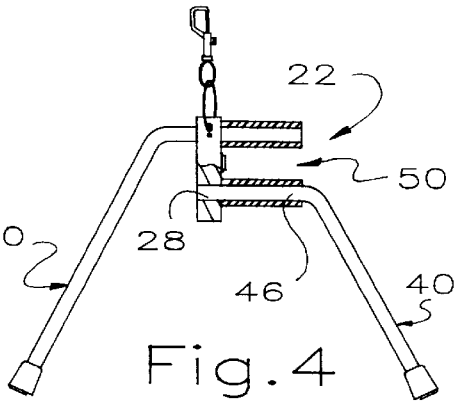
Fig. 4
Fig. 3
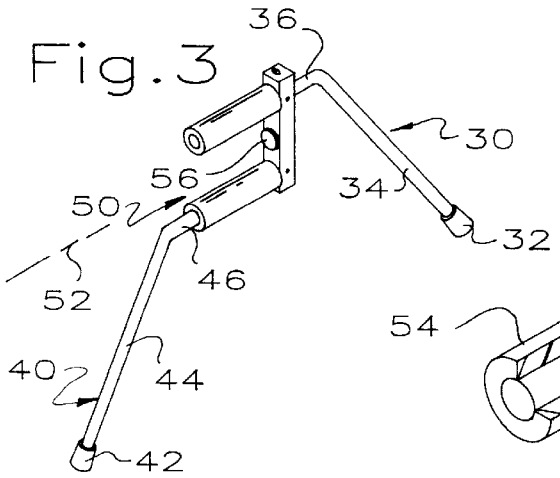
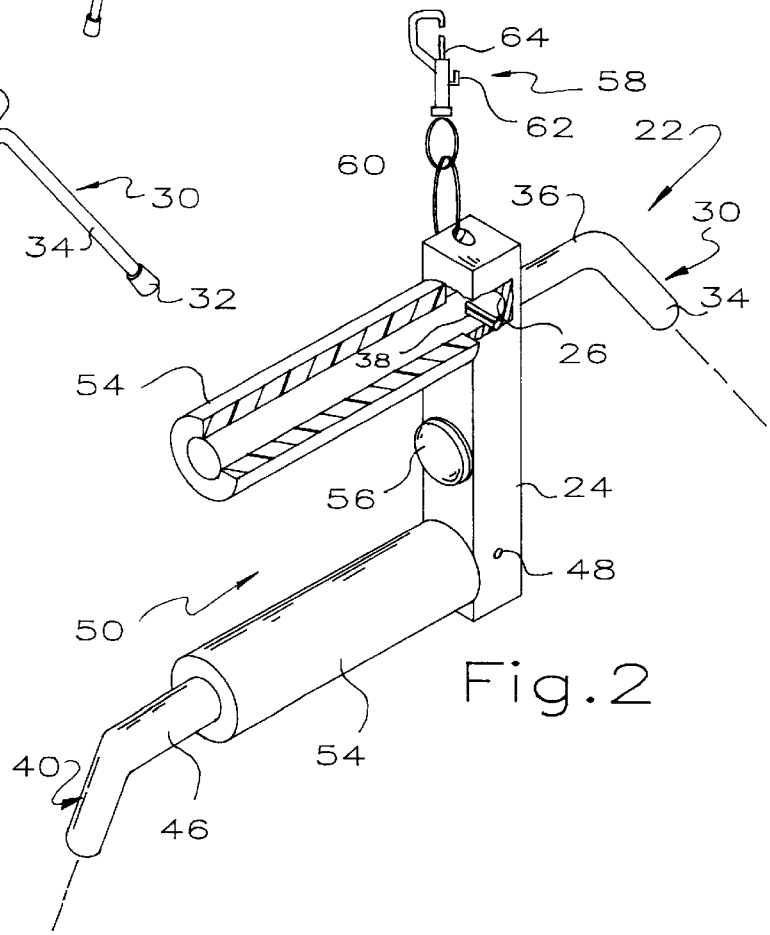
Fig. 2

ARCHERY BOW STAND

This invention is a stand for supporting a bow and, more particularly, a bow stand that is readily detached from the bow and conveniently stowed when the bow is being used.

BACKGROUND OF THE INVENTION

When competing in an archery competition or in simple recreational archery, there are long intervals when an archer is not shooting. During such periods, it is very desirable to have a support to hold the bow so the archer does not have to. There are typically no convenient permanent supports at typical competition or recreational archery ranges. It is important to support modern compound bows above ground level, rather than simply placing them on the ground. Modern compound bows are subject to cosmetic damage, but are also subject to mechanical damage from dirt getting into in the wheels, string, bushings and axles comprising the components of modern compound bows.

In response to this situation, proposals have been made in the prior art to provide stands for supporting an archery bow as shown in U.S. Pat. Nos. 3,256,872; 4,360,179; 4,474,296; 5,106,044; 5,711,467 and 5,775,658.

SUMMARY OF THE INVENTION

In this invention, an archery bow stand comprises a horizontal slot or notch to receive a portion of the upper or lower bow limb adjacent the lower or upper wheels or cams thereof, above or below the conventional forwardly extending stabilizer. The bow stand provides two or more laterally spaced feet. A plane is defined by the axis of the slot and the feet. The slot is capable of receiving something considerably thicker than the bow limb so the bow slips readily into the slot. The bow is leaned forwardly so the stabilizer contacts the underlying surface and the bow stand is inclined or canted to reduce the effective size of the slot, relative to the bow, and thereby place the bow stand and bow in a slight bind. The bow is accordingly supported in a stable tripod-like arrangement with the stabilizer providing one foot and the bow stand providing the other two feet.

An important feature of this invention is the ability to stow the bow stand when the bow is being used. The bow stand is easily removed from the bow because the bow is simply moved out of the slot or vice-versa. The bow stand is attached to the user by a removable clip that attaches to the user's clothing or accessories, such as to a quiver, belt loop or the like.

It is an object of this invention to provide an improved archery bow stand for supporting a bow when not in use.

A further object of this invention is to provide a bow stand incorporating a wide horizontal slot for receiving an upper or lower portion of the bow and cooperating with a bow stabilizer for supporting the bow in a stable tripod arrangement.

Another object of this invention is to provide a bow stand which is easily removed from the bow and stowed in a convenient manner.

A further object of this invention is to provide an improved bow stand that is simple, lightweight and inexpensive yet provides a sturdy stable support for an archery bow.

These and other objects and advantages of this invention will become more apparent as this description proceeds, reference being made to the accompanying drawings and appended claims.

BRIEF DESCRIPTION OF THE DRAWINGS

FIG. 1 is view of a bow and bow stand of this invention; and

FIG. 2 is an enlarged partial isometric view of the bow stand of this invention;

FIG. 3 is a smaller isometric view similar to FIG. 2; and

FIG. 4 is a side view of the bow stand of FIGS. 1–3, certain parts being broken away for clarity of illustration.

DETAILED DESCRIPTION

Referring to FIGS. 1–4, a modern compound bow 10 comprises a straight or recurved bow limb 12 having a lower end 14, an upper end attached to a riser 16 having an arrow launching position or shelf and a tensioned bow string 18 connecting the upper and lower ends of the bow 10. A stabilizer 20 normally attaches to the riser 16 below the shelf and extends away from the bow string 18.

A bow stand 22 of this invention comprises a member 24 providing a pair of parallel passages 26, 28 therethrough. A first leg 30 provides a foot 32, an inclined section 34 and a horizontal section 36 extending through the upper passage 26. A pin 38 or other suitable device secures the leg 30 in the member 24. A second leg 40 provides a foot 42, an inclined section 44 and a horizontal section 46 extending through the lower passage 28. A pin 48 or other suitable device secures the leg 40 in the member 24.

It will be seen that the horizontal sections 36, 46 of the legs 30, 40 provide a horizontal slot 50 for receiving the bow limb 12 and that the legs 30, 40 comprise a base for supporting the horizontal slot 50. It will also be seen that the bow stand 22 preferably lies in a common plane defined by the feet 32, 42 and the axis 52 of the slot 50. It will be apparent that the bow stand 22 can be made of any suitable metal, such as aluminum, or suitable injection molded plastic.

If the bow stand 22 is made of metal or other material that can mar the surface of the bow limb 12, suitable steps should be taken to coat the slot 50 to prevent this. The horizontal sections 36, 46 of the legs 30, 40 accordingly receive rubber or plastic tubing 54 and a resilient bumper 56 is placed on the member 24 in the bight of the slot 50.

In use, the archer places the bow stand 22 on an underlying surface and places the bow limb 12 in the horizontal slot 50. The bow 10 is then leaned forwardly until the stabilizer 20 comes to rest on the underlying surface. The archer then inclines the stand 22 relative to the bow 10 in any suitable manner, as by kicking the stand 22 in a movement similar to a bicycle rider kicking the kick stand of a bicycle. The bow stand 22 may be moved rearwardly, analogous to kicking the bicycle kick stand toward the retracted position, or moved forwardly, analogous to kicking the bicycle kick stand toward the extended position. In either event, this places the bow stand 22 and bow 10 in a slight bind and in a stable tripod arrangement.

If the bow 10 has a long stabilizer 20, the user normally places the lower bow limb 12 into the slot 50. If the stabilizer 20 is short, the user nomrally places the upper bow limb into the slot 50.

An important feature of this invention is the ability to stow the bow stand 22 when the bow 10 is being used. To this end, a conventional releasable clip 58 is attached to the member 24 in any suitable manner, such as by one or more rings 60. The clip 58 includes a button 62 that retracts a retainer 64 so the clip 58 may be attached to the quiver, belt loop or other suitable point of attachment carried by the user.

Aluminum prototypes of this invention weigh about six ounces so the bow stand 22 is easily carried by the user when shooting.

For purposes of discussing the orientation of the slot 50, it is considered to have a closed end adjacent the button 56, an open end opposite from the button 56 and open sides through which the bow limb 12 extends.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. In combination, an archery bow providing an arrow launching position, a bow limb, a tensioned bow string and a stabilizer extending away from the bow string; and a bow stand receiving and stably supporting the bow limb on an underlying surface with the stabilizer providing a forward leg and the bow stand providing at least a pair of rearward legs.

2. The combination of claim 1 wherein the bow stand comprises a horizontal slot receiving the bow limb below the stabilizer.

3. The combination of claim 2 wherein the horizontal slot comprises an open ended slot loosely receiving the bow limb and the bow stand is movable to an inclined position where the horizontal slot closely receives the bow limb.

4. The combination of claim 1 wherein the bow stand removably receives the bow limb and further comprising means for attaching the bow stand to a user.

5. The combination of claim 4 wherein the attaching means comprises a removable clip.

6. The combination of claim 1 wherein the bow comprises a riser providing the arrow launching position, the stabilizer being attached to the riser.

7. A stand for an archery bow of the type having upper and lower ends, an arrow launching position between the ends and a stabilizer, the stand comprising a horizontal slot for receiving the bow between the stabilizer and one end, and a base comprising at least a pair of feet for supporting the bow in cooperation with the stabilizer.

8. The bow stand of claim 7 further comprising means for removably attaching the bow stand to the user.

9. The bow stand of claim 8 wherein the attaching means comprises a removable clip.

10. The bow stand of claim 7 wherein the base comprises a pair of legs diverging away from the horizontal slot.

11. The bow stand of claim 7 wherein there are only two feet.

12. The bow stand of claim 7 wherein the horizontal slot is open on one end.

13. The bow stand of claim 7 wherein the horizontal slot provides an axis and the axis and feet lie in a common plane.

14. The bow stand of claim 7 wherein the base comprises a pair of legs each having a horizontal section providing the horizontal slot therebetween and an inclined leg.

15. An archery bow stand comprising a central member, a first leg comprising a first inclined section having a first foot thereon and a first horizontal section extending into the central member, a second leg comprising a second inclined section having a second foot thereon and a second horizontal section extending into the central member and providing, in combination with the first horizontal section, a horizontal slot for receiving a bow limb.

16. The bow stand of claim 15 further comprising means for removably attaching the bow stand to the user.

17. The bow stand of claim 15 wherein the horizontal slot is open on one end.

18. The bow stand of claim 15 wherein the horizontal slot provides an axis and the axis and feet lie in a common plane.

19. A stand for an archery bow comprising at least a pair of legs for supporting the bow from an underlying surface, a frame rigid with the legs for removably receiving the bow and supporting the bow and a releasable clip for releasably attaching the stand to a user.

* * * * *